US010006396B2

(12) United States Patent
Imhof et al.

(10) Patent No.: US 10,006,396 B2
(45) Date of Patent: Jun. 26, 2018

(54) FUEL INJECTOR

(71) Applicant: GE Jenbacher GmbH & Co OG, Jenbach (AT)

(72) Inventors: Dino Imhof, Munich (DE); Georg Tinschmann, Schwaz (AT)

(73) Assignee: GE Jenbacher GmbH CO OG, Jenbach (AT)

( * ) Notice: Subject to any disclaimer, the term of this patent is extended or adjusted under 35 U.S.C. 154(b) by 21 days.

(21) Appl. No.: 14/964,988

(22) Filed: Dec. 10, 2015

(65) Prior Publication Data

US 2016/0195033 A1 Jul. 7, 2016

(30) Foreign Application Priority Data

Jan. 2, 2015 (AT) ..... A 5/2015

(51) Int. Cl.
*F02D 41/30* (2006.01)
*F02M 61/16* (2006.01)
*F02M 47/02* (2006.01)

(52) U.S. Cl.
CPC ..... *F02D 41/30* (2013.01); *F02M 47/027* (2013.01); *F02M 61/16* (2013.01); *F02M 2200/315* (2013.01); *F02M 2200/40* (2013.01)

(58) Field of Classification Search
CPC ..... F02D 41/30; F02M 61/16; F02M 47/027; F02M 2200/40; F02M 2200/315
USPC ..... 701/104
See application file for complete search history.

(56) References Cited

U.S. PATENT DOCUMENTS

| | | | | |
|---|---|---|---|---|
| 6,336,598 | B1 * | 1/2002 | Touchette | F02D 19/10 239/408 |
| 6,761,325 | B2 * | 7/2004 | Baker | F02M 43/02 239/533.2 |
| 7,025,045 | B2 * | 4/2006 | Hlousek | F02M 47/027 123/447 |
| 7,059,303 | B2 * | 6/2006 | Magel | F02M 47/027 123/447 |
| 7,603,984 | B2 | 10/2009 | Ganser | |
| 9,447,720 | B2 | 9/2016 | Graspeuntner et al. | |
| 2004/0055574 | A1 | 3/2004 | Namekawa et al. | |
| 2013/0319373 | A1 * | 12/2013 | Brown | F02M 43/04 123/456 |
| 2017/0002780 | A1 * | 1/2017 | Kalenborn | F02M 63/0045 |

FOREIGN PATENT DOCUMENTS

| | | |
|---|---|---|
| DE | 10 2006 051 583 | 5/2008 |
| DE | 10 2013 204 289 | 10/2014 |
| DE | 10 2013 021 810 | 6/2015 |
| EP | 1614894 | 1/2006 |
| JP | 2004036423 A | 2/2004 |

(Continued)

OTHER PUBLICATIONS

Extended European Search Report dated Apr. 29, 2016, in corresponding European Application No. 15 00 3476.

(Continued)

*Primary Examiner* — Joseph Dallo
*Assistant Examiner* — Scott A Reinbold
(74) *Attorney, Agent, or Firm* — GE Global Patent Operation; Rita D. Vacca

(57) ABSTRACT

A fuel injector has a storage volume, wherein the storage volume is variable in operation by a control signal.

10 Claims, 9 Drawing Sheets

(56) References Cited

FOREIGN PATENT DOCUMENTS

Figure 1:
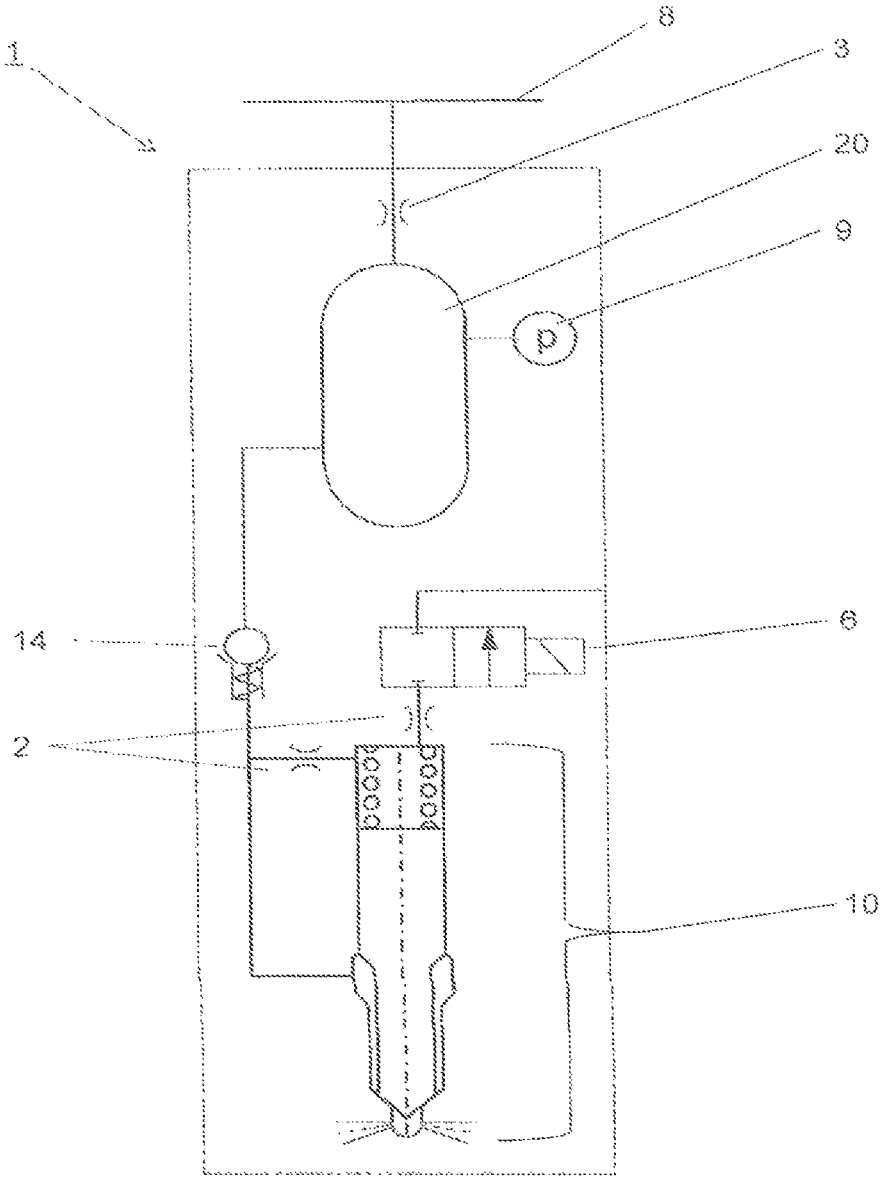

| | | | |
|---|---|---|---|
| JP | 2005519233 | A | 6/2005 |
| JP | 2006017048 | A | 1/2006 |
| JP | 2007132215 | A | 5/2007 |
| JP | 2009501863 | A | 1/2009 |
| JP | 2010164037 | A | 7/2010 |
| JP | 2010180797 | A | 8/2010 |
| JP | 2013541670 | A | 11/2013 |
| WO | 02/092998 | | 11/2002 |
| WO | 2005031138 | A1 | 4/2005 |

OTHER PUBLICATIONS

Austrian Search Report dated Jun. 30, 2015 in corresponding Austrian Patent Application No. 5/2015 (with English translation).
Unofficial English translation of Office Action issued in connection with corresponding JP Application No. 2015-240910 dated Dec. 13, 2016.
Unofficial English Translation of Chinese Office Action issued in connection with corresponding CN Application No. 201511036287.4 dated Nov. 1, 2017.

* cited by examiner

State of the art

FUEL INJECTOR

The invention concerns a fuel injector having the features of the classifying portion of claim 1, an internal combustion engine having such a fuel injector and a method of operating an internal combustion engine.

Fuel injectors of modern internal combustion engines operate with high fuel pressures. In order not to transmit to the fuel supply pressure pulsations resulting from the fuel injector switching operations which occur in quick succession a storage volume is provided in the injector itself, from which storage volume the fuel is taken for injection and into which fuel can flow as a make-up flow from the fuel supply line by way of a throttle (aperture). That therefore provides for oscillation decoupling of the injector from the fuel supply. A fuel injector having such a storage volume is known for example from DE 10 2006 051 583 A1.

For effective damping of pressure oscillations the above-mentioned storage volume must be in a given ratio with the amount of fuel which is taken in a switching operation and which is therefore injected by the fuel injector into the combustion chamber. If the storage volume is excessively small the pressure in the storage volume collapses excessively upon injection, while larger volumes are more difficult to achieve for reasons of space. As the damping action is determined from the cooperation of the storage volume and the throttle the flow cross-section, that is to say the hydraulic damping action of the throttle, is adapted to the size of the storage volume.

Fuel injectors are already known in which the injection amounts are variable. It would be desirable to make the injection amounts of a fuel injector variable to a greater degree. In other words a fuel injector is to have a high turndown ratio. The turndown ratio of a fuel injector is the ratio of the maximum and the minimum amount of fuel which a fuel injector can inject in controlled relationship. If a fuel injector can represent an amount of fuel of between 0.5% and 100% then that fuel injector has a turndown ratio of 200. That is relevant in particular for dual fuel engines which are intended to be operated in modes of between 100% diesel to a gas mode with a small diesel pilot injection. It is of particular significance that the turndown ratio is to be of those values in a controlled and reproducible fashion over the entire service life of the fuel injector.

As a reproducible turndown ratio of 200 cannot be implemented with a single fuel injector for the entire service life in the state of the art a solution for dual fuel engines involves providing two separate fuel injectors, wherein one fuel injector provides for the large amounts of fuel for the diesel mode and the second provides for the small amounts of fuel for the pilot injection.

Therefore the object of the invention is to provide a fuel injector which can be used over wide ranges of the injection amount without suffering from the disadvantages of the state of the art. The invention also seeks to provide an internal combustion engine and a method of operating same.

Those objects are attained by a fuel injector having the features of claim 1, an internal combustion engine as set forth in claim 10 and a method of operating an internal combustion engine as set forth in claim 10. Advantageous configurations are set forth in the appendant claims.

The fact that the storage volume is variable in operation by a control signal provides that the size of the storage volume can thus be adapted to the respective injection amount.

For, as stated in the opening part of this specification, the injection amounts can differ in dependence on the operating state of the internal combustion engine.

The variability in operation provides substantial advantages.

By virtue of the variability of the storage volume it is possible for example to abandon the double implementation of fuel injectors, in which specific fuel injectors are provided for different operating states. Operating states are for example the diesel mode in which all the fuel is supplied as diesel and the dual fuel mode in which diesel is supplied only for ignition (so-called pilot injection) and in small amounts.

The variability of the storage volume in operation means that the internal combustion engine does not have to be shut down to vary the storage volume.

It is particularly preferably provided that the storage volume corresponds to between about 30 and 80 times the injected amount.

It can preferably be provided that the storage volume comprises at least two sub-volumes which can be communicated by way of a switching element in such a way that they act as an overall volume within the injector, wherein the overall volume is matched to the larger injection amount. This means that the storage volume is not formed by a single cavity but by at least two sub-volumes which can be combined together. Thus in the case of larger injection amounts the at least second sub-volume is brought into fluid communication with the first sub-volume whereby a greater capacity of the storage volume is available for taking off fuel in the injection process.

If only small injection amounts are required only one of the sub-volumes is operated. In that case therefore only one sub-volume is in fluid communication between the high-pressure rail and the actual nozzle assembly. Logically the sub-volume for small injection amounts is of smaller size than that for the operating state involving larger injection amounts.

It can be provided that the arrangement of the at least two sub-volumes is in parallel flow relationship. In that case both or all of the at least two sub-volumes are connected to the high pressure rail. The switching element is then arranged downstream of the one sub-volume and can be actuated in such a way that it closes off said one sub-volume. Then only the second sub-volume is still in communication with the nozzle assembly. In the injection operation therefore fuel is taken only from that further sub-volume.

Formulated here for two sub-volumes the arrangement can also include more than two sub-volumes. They can then be closed or opened by further switching elements. In practice that is scarcely implemented solely for reasons of space.

Alternatively it can be provided that the arrangement of the at least two sub-volumes is in serial flow relationship. In that case therefore there is only one communication for the sub-volumes with the high pressure rail. The switching element is then arranged for example in flow relationship between the sub-volumes. When the switching element is closed therefore fuel is taken in the injection operation only from that sub-volume which is between the switching element and the nozzle assembly. In the case of the serial arrangement the switching element is so designed as to ensure a further flow of fuel into the downstream-disposed sub-volume. That can be effected for example by an always remaining opening, in the closed position, through which fuel can further flow like a throttle.

As an alternative to the provision of sub-volumes it can be provided that the storage volume is in the form of a cavity of variable capacity. In this variant therefore adaptation of the capacity of the storage volume to the current requirement, for example the injection amount, is achieved by the size of the cavity itself being variable. That can be represented for example by a displacement body by which the storage volume capacity that is free, that therefore can be occupied by fuel, is variable. The displacement body can for example be in the form of a piston or a gas bubble. The fuel can be for example gasoline, diesel or heavy oil.

Protection is also claimed for an internal combustion engine having a fuel injector according to the invention and a method of operating an internal combustion engine. By the variation in the capacity of the storage volume of the fuel injector in dependence on an operating state of the internal combustion engine, the injection characteristic can therefore be adapted to different operating states of the internal combustion engine.

Figure 2:
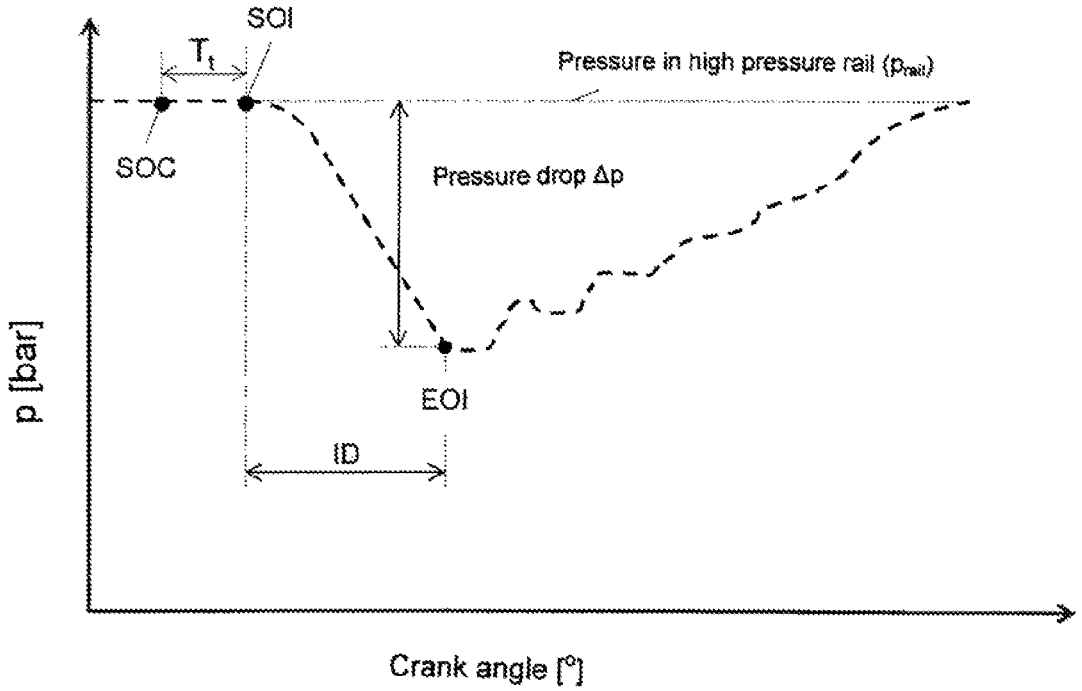
Figure 3:
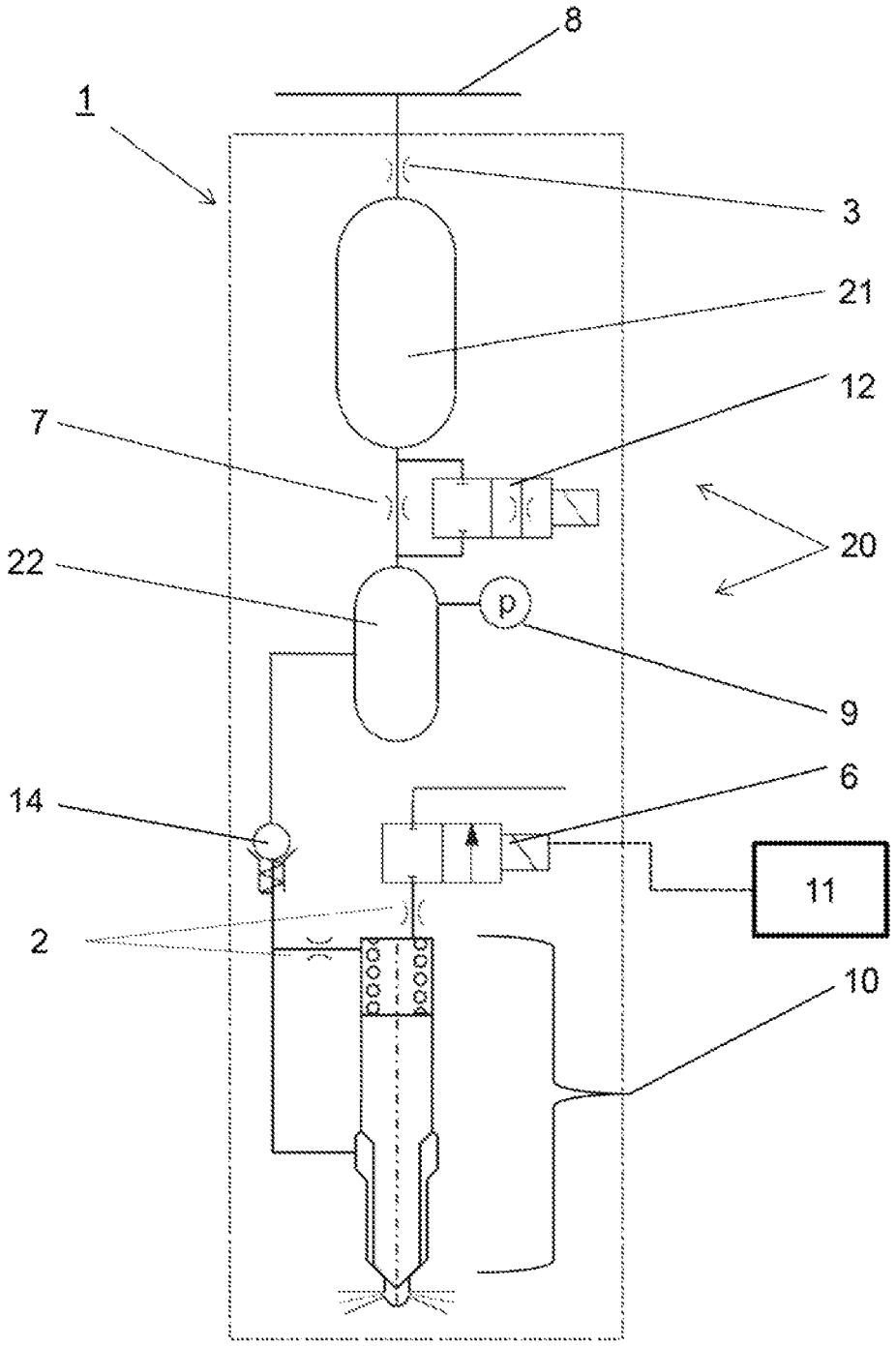
Figure 4:
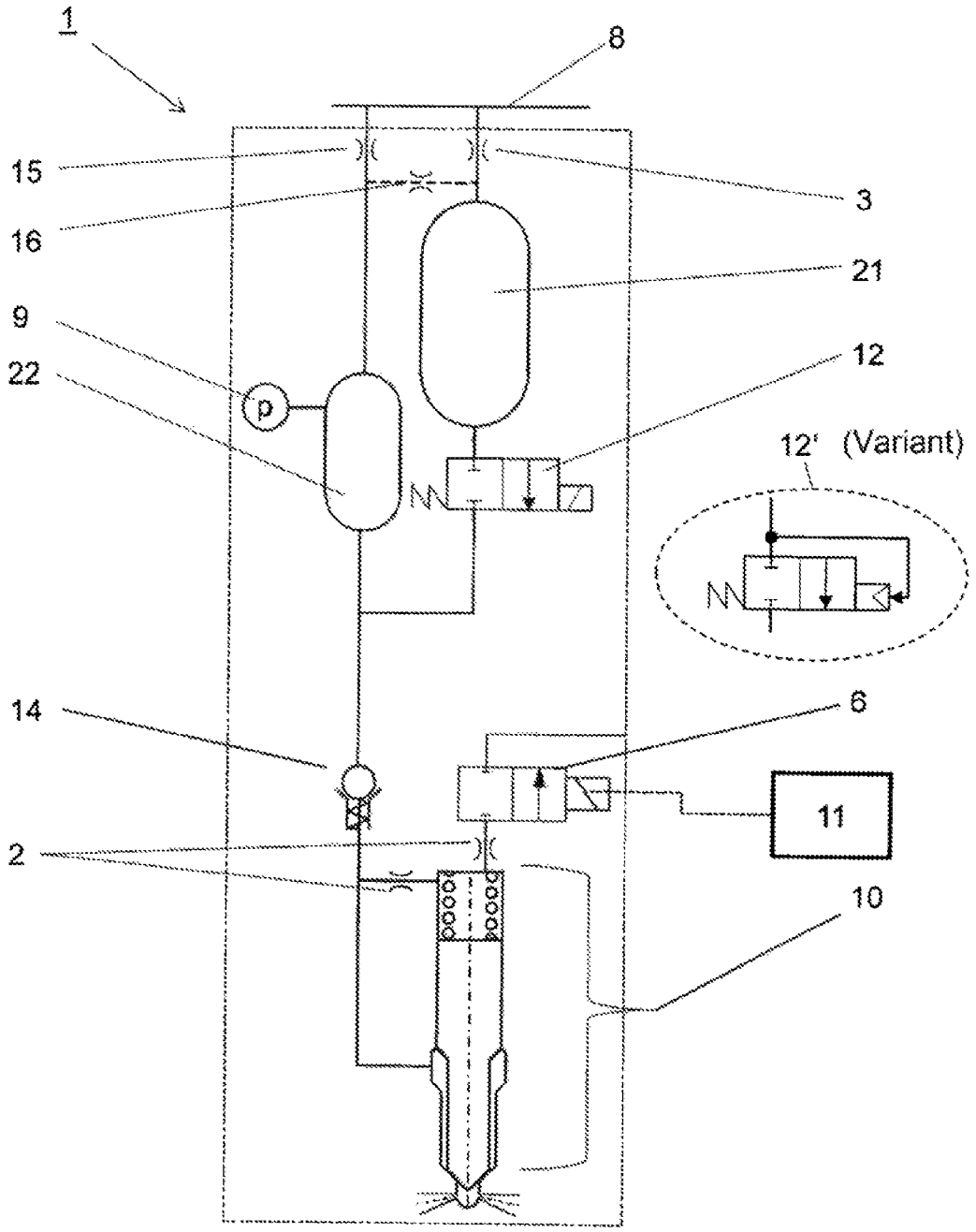
Figure 5:
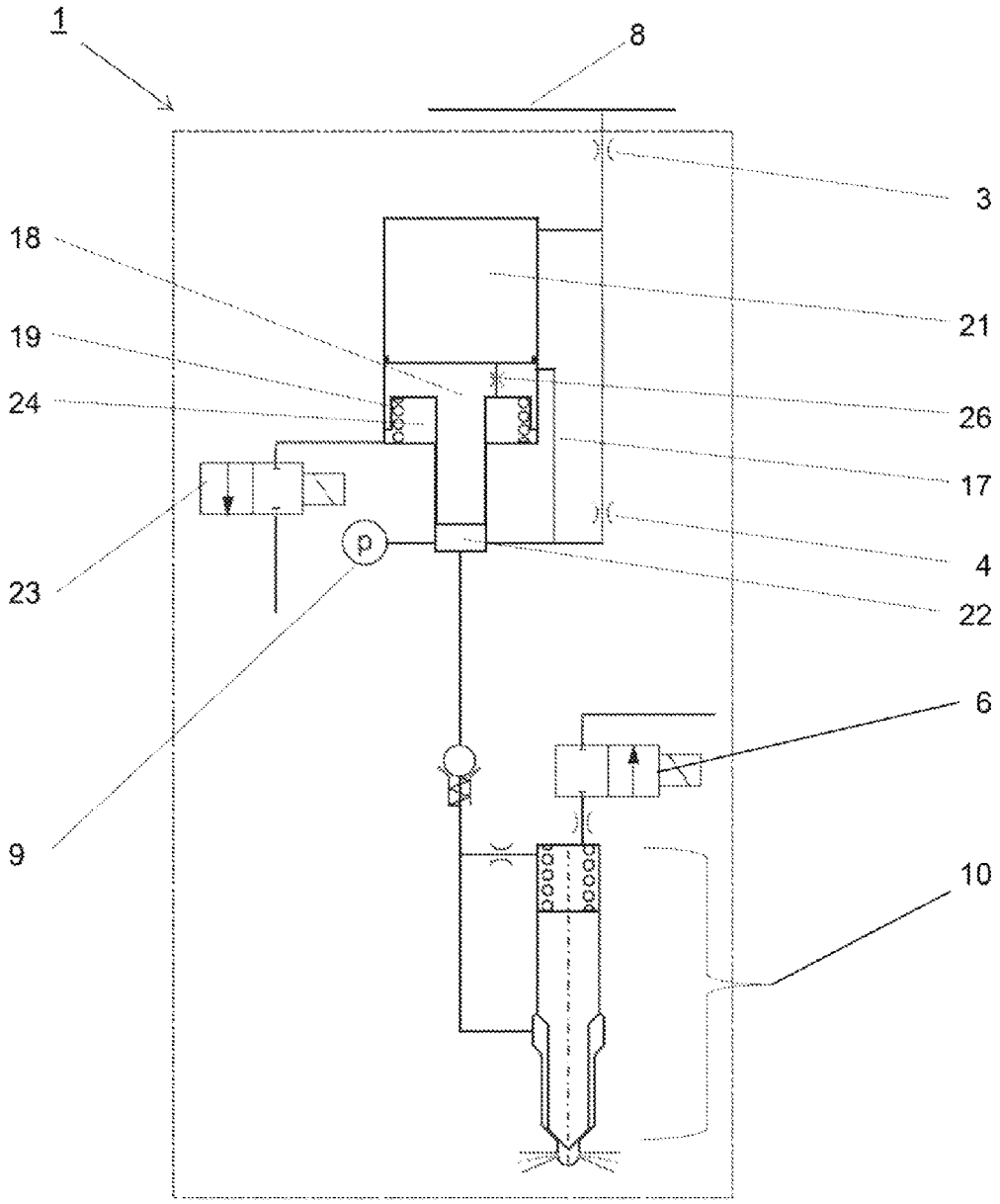
Figure 6:
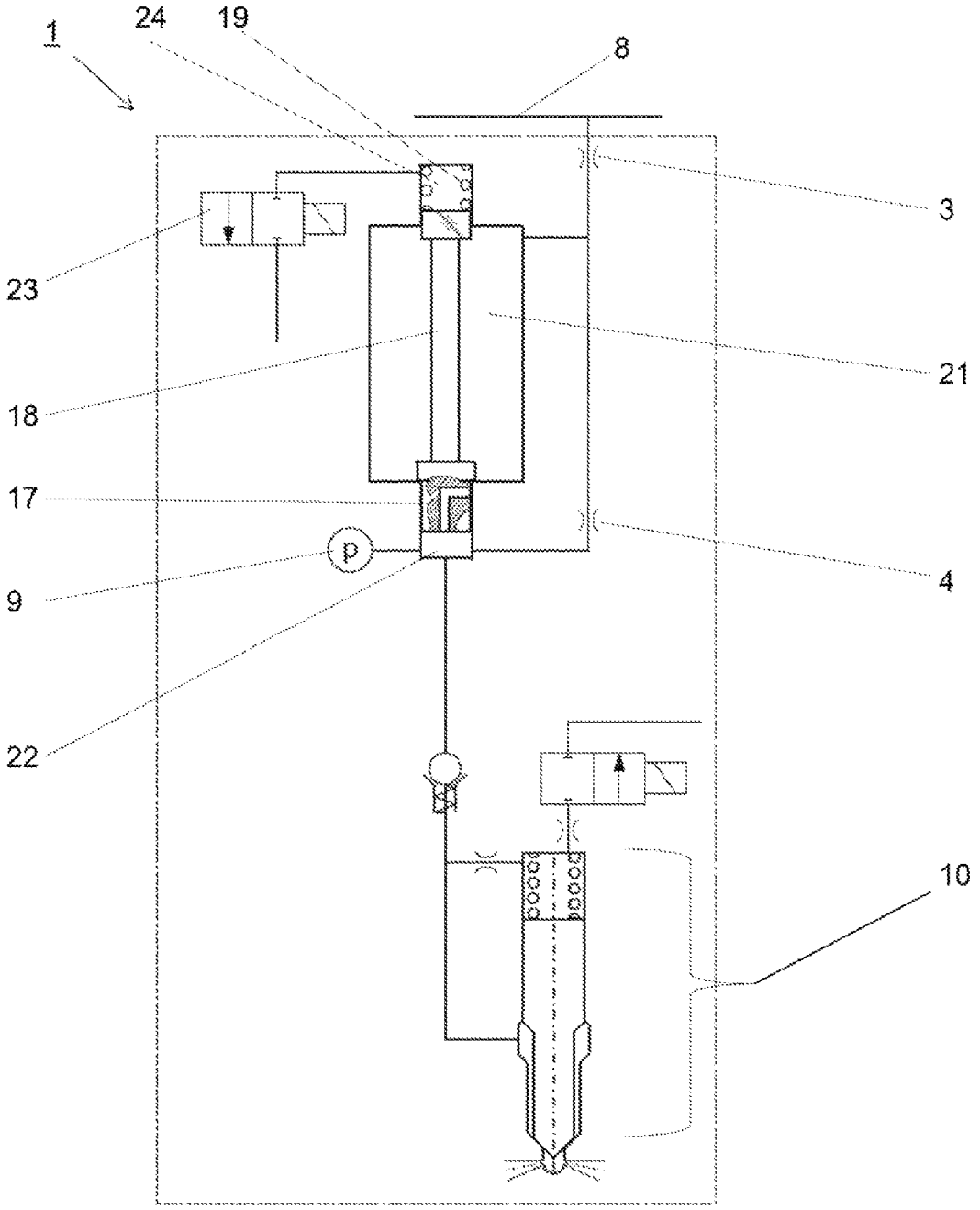
Figure 7:
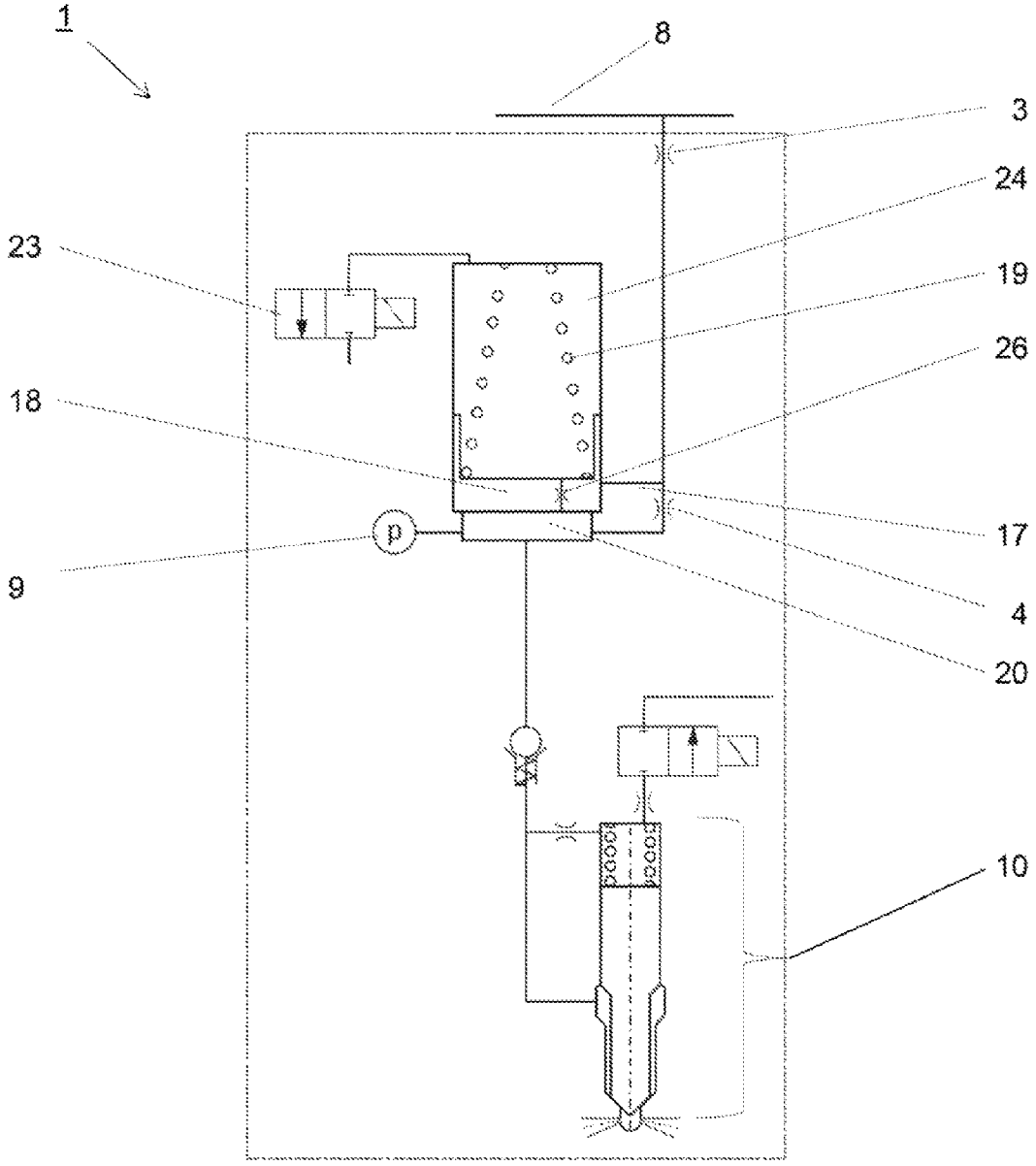
Figure 8:
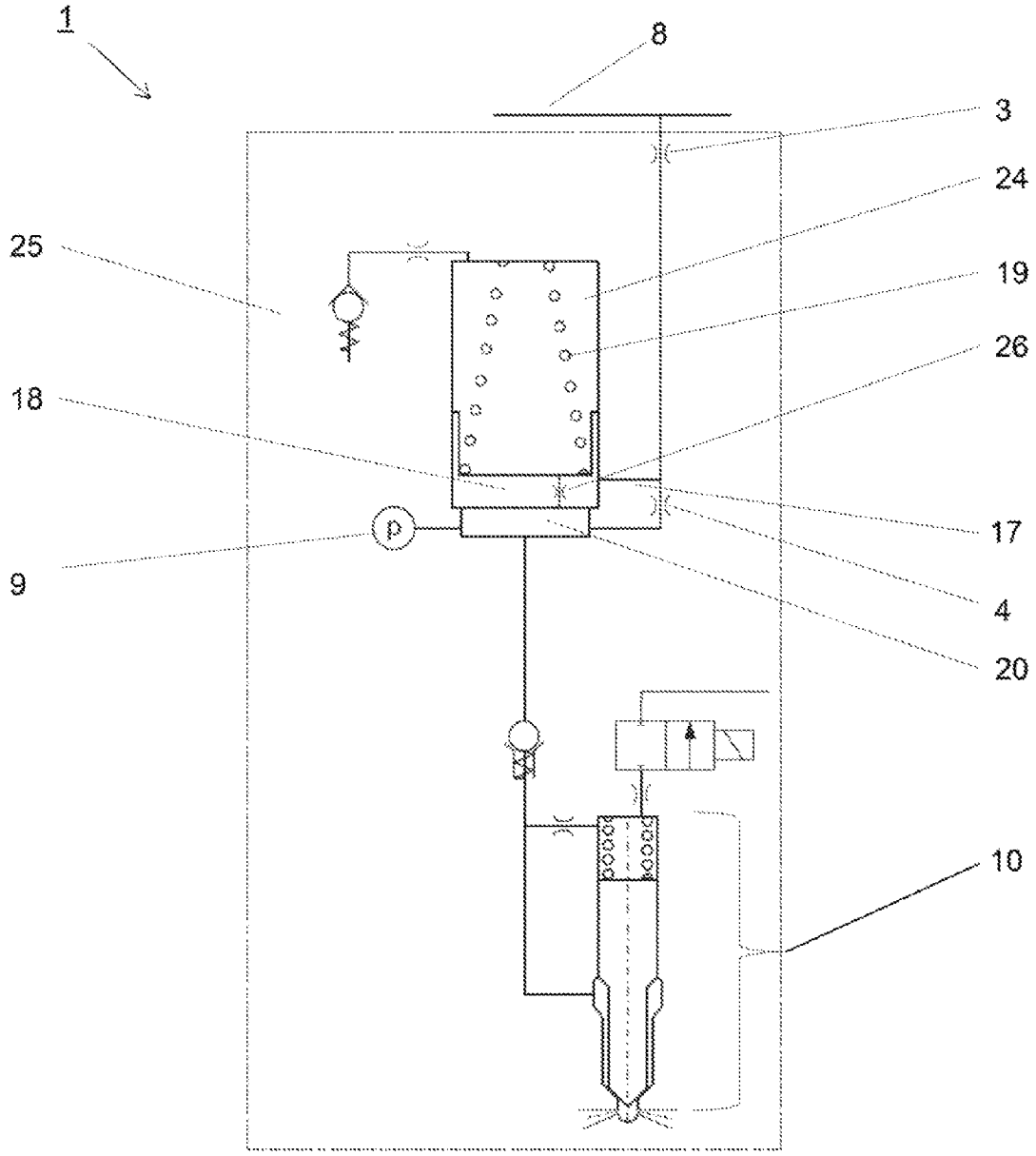
Figure 9:
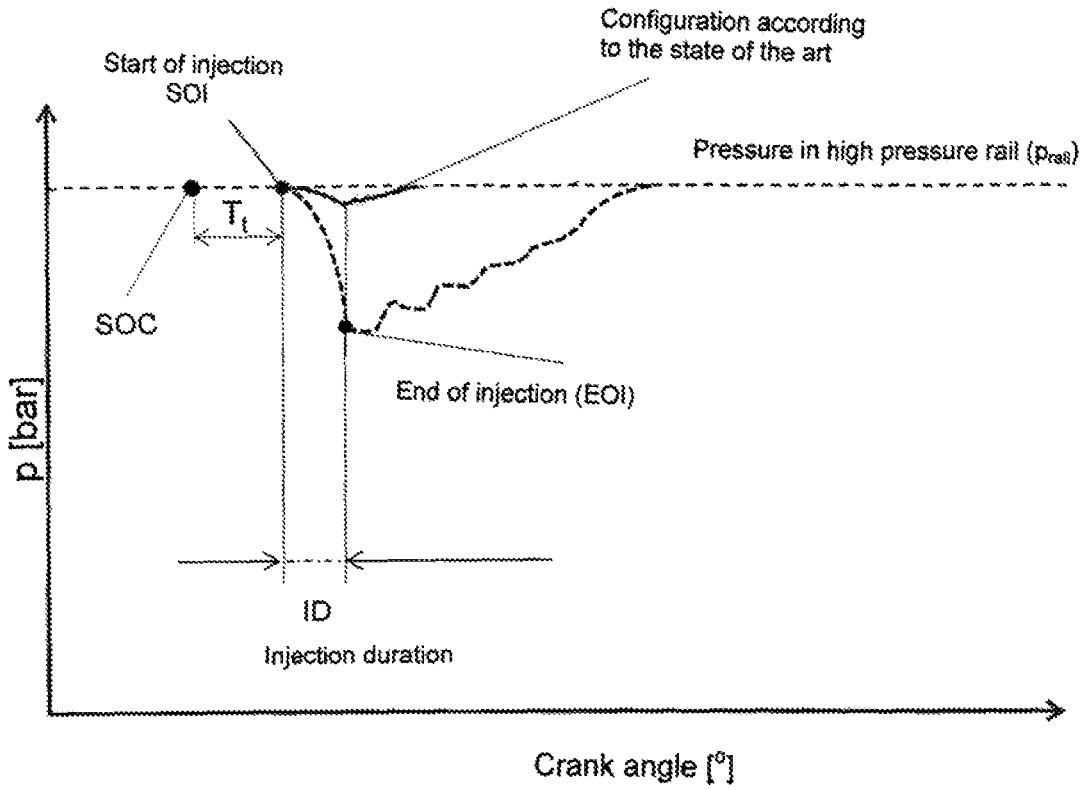

The invention will be described in greater detail hereinafter with reference to the Figures in which:

FIG. 1 shows a fuel injector in accordance with the state of the art,

FIG. 2 shows the pressure variation in the storage volume in accordance with the state of the art, FIG. 3 shows a fuel injector in accordance with a first embodiment, FIG. 4 shows a fuel injector in accordance with a further embodiment, FIG. 5 shows a fuel injector in accordance with a further embodiment, FIG. 6 shows a fuel injector in accordance with a further embodiment, FIG. 7 shows a fuel injector in accordance with a further embodiment, FIG. 8 shows a fuel injector in accordance with a further embodiment, and FIG. 9 shows pressure variations in the storage volume as a comparison.

FIG. 1 shows a fuel injector 1 with storage volume 20 in accordance with the state of the art. A dotted-line frame shows the system limits of the fuel injector 1.

A high pressure rail 8 supplies the fuel injector 1 with fuel by way of an aperture 3. Arranged downstream of the aperture 3 is a storage volume 20 which is integrated into the fuel injector 1. The aperture 3 reduces pressure oscillations and alleviates deviations from one cylinder to another. The illustrated fuel injector 1 has a pressure sensor 9 at the storage volume 20.

A line leads from the storage volume 20 to a nozzle assembly 10. The nozzle assembly 10 can be actuated by a control valve 6. Feed and discharge throttles 2 are arranged between the control valve 6 and the nozzle assembly 10. The nozzle assembly has a hydraulically actuable needle by way of which fuel is delivered. The needle is controlled by the control valve 6 together with the feed and discharge throttles 2. In general a through-flow limiter 14 is provided as a safety member in the feed line to the nozzle assembly 10, but is not necessarily required.

FIG. 2 shows the pressure variation in the storage volume 20 during an injection operation, as is known from the state of the art.

For detecting the pressure variation, arranged for that purpose on the storage volume 20 is a pressure sensor 9 with which the pressure changes during the injection operation can be detected. The pressure in the storage volume 20 is plotted in the graph in bars in relation to the crank angle in degrees. The time classification of the illustrated events is expressed in degrees of crank angle.

The pressure in the storage volume 20, prior to the start of injection, corresponds to the pressure in the high pressure rail 8.

At the time SOC (start of current) current is supplied to the fuel injector 1 so that injection begins after a dead time $T_t$.

After the start of injection at the time SOI (start of injection) the pressure in the storage volume 20 falls to the value which is reached at the end of injection (EOI).

The injection duration is identified by the reference ID.

The observed pressure drop in the storage volume 20 is characterised in the graph by $\Delta p$.

The injected amount or mass of fuel can be calculated from the pressure variation by virtue of knowledge of the parameters pressure in the high pressure rail 8, injection duration, effective flow cross-section of the aperture 3 between storage volume and high pressure rail 8, flow properties of the fuel and so forth. In other words the injected amount of fuel is a function of those parameters.

It can be easily seen that the data quality and thus the accuracy of calculation of the injected mass of fuel are dependent on the resolution of the pressure measurement at the storage volume 20. The pressure signal in turn is heavily dependent on the effective flow cross-section of the aperture 3 and the capacity of the storage volume 20. The greater the free aperture cross-section and the greater the storage volume 20, the correspondingly less is the pressure drop $\Delta p$ during the injection operation. Therefore calculation of the amount of fuel, especially when small injection amounts are required, becomes difficult and accuracy becomes unsatisfactory.

FIG. 3 shows a fuel injector 1 according to the invention in accordance with a first embodiment.

In this case two sub-volumes 21, 22 are arranged serially. The sub-volumes 21, 22 together give the storage volume 20.

A first aperture 3 is provided between the first sub-volume 21 and the high pressure rail 8. A further aperture 7 is arranged between the storage volumes 21 and 22. The aperture 7 can be by-passed by a switching element 12 in the form of a by-pass. In the illustrated embodiment the switching element 12 is in the form of an electrically actuable switching valve. Other configurations are conceivable for the switching element 12, for example pneumatically or hydraulically actuable valves.

When only small amount of fuel are injected, as required for example in the dual fuel mode, the switching element 12 is closed. This means that the flow communication between the sub-volumes 21, 22 is determined by the further aperture 7. The further aperture 7 is so designed that fluid can further flow from the sub-volume 21 into the sub-volume 22 only with a severe delay. In other words, there is only a small free aperture cross-section available between the sub-volumes 21 and 22 so that the fuel withdrawal characteristic is substantially determined by the sub-volume 22.

If larger injection amounts are required then the switching element 12 is so switched that it opens a larger free total flow cross-section. In that way the storage volumes 21 and 22 communicate with each other in substantially non-throttled relationship so that the fuel withdrawal characteristic corresponds to the common volume 20, that is to say the sum of the sub-volumes 21, 22.

Naturally all intermediate stages can also be envisaged, that is to say the switching element 12 between the sub-volumes 21 and 22 is varied steplessly or in steps between a minimum and a maximum position. A binary solution with only two switching positions of the switching element 12 is however less expensive to implement and is therefore preferred. A maximum position means that the switching element 12 is completely opened and there is thus no hydraulic damping between the volumes 21 and 22.

In practice the arrangement of the sub-volumes 21 and 22 is such that the sub-volume 22 has the capacity suited to the dual fuel mode. In other words, as explained above, the capacity of the sub-volume 22 corresponds to between about 30 and 80 times the injection amount in the dual fuel mode.

In contrast the sub-volume 21 is so dimensioned that in combination with the sub-volume 22 this gives a total volume 20 for the sub-volumes 21 and 22, which corresponds to between 30 and 80 times the injection amount in the diesel mode. A numerical example in this respect: let the injection amount in the diesel mode be 100% with a volume to be injected of 1000 $mm^3$ per working cycle. That gives for the capacity of the total volume of the sub-volumes 21 and 22 an acceptable total volume in a range of between 30000 and 80000 $mm^3$ (between thirty thousand and eighty thousand).

With a turndown ratio of 200 (100) that gives the magnitude of the sub-volume 22 for the dual fuel mode as 1/200 (1/100) of the total volume of the sub-volumes 21 and 22, and is therefore in a range of between 150 and 400 (between 300 and 800) $mm^3$. The values in brackets relate to a turndown ratio of 100.

A pressure sensor 9 can be set up at the storage volume 22. Due to the arrangement according to the invention of the sub-volumes the volume which is respectively used and the injection amount are in a suitable ratio, which makes more precise measurement of the pressure variation during injection possible. That in turn allows more accurate calculation of the injection amount.

The nozzle assembly 10 corresponding to the state of the art is further shown, but not described in greater detail. In this example the assembly 10 comprises an injection needle with is hydraulically actuable by means of a control valve 6 and which receives switching pulses by way of a control device 11. The injection needle can naturally also be in the form of a piezo-injector. In that case, the components of the nozzles assembly 10, that are required for hydraulic actuation, are naturally eliminated. In general a through-flow limiter 14 is provided as a safety member in the feed line to the nozzle assembly 10, but is not necessarily required.

FIG. 4 shows an embodiment with a parallel arrangement of the sub-volumes 21 and 22. Therefore the sub-volumes 21 and 22 of the storage volume 20 are arranged in parallel flow relationship. The sub-volume 21 is fed by way of the aperture 3 from the high pressure rail 8. The storage volume 20 can be switched on and off by way of an electrically actuable switching element 12.

If only small amounts of fuel are injected, as required for example in the dual fuel mode, the switching element 12 is closed. When the switching element 12 is closed the fluid communication between the sub-volume 21 and the nozzle assembly 10 is interrupted. In that case the injection characteristic is determined by the—smaller—sub-volume 22. The sub-volume 22 is fed by way of a further aperture 15 from the high pressure rail 8.

If larger amount of fuel are to be injected as in the diesel mode then the switching element 12 is opened. Accordingly both sub-volumes 21, 22 are available for withdrawing fuel.

Emphasized in the broken-line oval is an alternative embodiment of the switching element 12 identified by reference 12'. The switching element 12' is a valve which is switched directly by the pressure in the sub-volume 21.

Unlike the illustrated configuration the fuel injector 1 does not have to be provided with two inputs for the high pressure rail 8. One input is also sufficient, which suitably branches upstream of the sub-volumes 21, 22. That variant is shown in FIG. 4 in broken line with the aperture 16. In this case the aperture 16 replaces the aperture 15. The line portion to the high pressure rail 8, in which the aperture 15 is disposed, is eliminated. The communication with the high pressure rail 8 is then therefore effected by way of the aperture 3.

A pressure sensor 9 can again be set up at the storage volume 22. The remaining structure of the fuel injector 1 corresponds to that in FIG. 3. The advantages are the same as described in relation to the FIG. 3 embodiment. The values relating to FIG. 3 can be used as a numerical example.

FIG. 5 shows an embodiment with variable sub-volumes 21, 22.

For that purpose there is provided a displaceable piston 18 separating the sub-volumes 21 and 22 from each other. The content of the sub-volume 21 communicates with the spring chamber 24 through the throttle 26.

In the illustrated position the (smaller) sub-volume 22 is in fluid communication with the nozzle assembly 10, that is to say the injection amount is taken from the sub-volume 22, as is required for example in the dual fuel mode. In this operating state throttling with respect to the high pressure rail is effected by way of the aperture 4.

Upon actuation of the control valve 23 the spring chamber 24 in which the spring pack 19 is disposed is relieved of pressure. Thereupon the piston 18 moves downwardly in this view.

In the illustrated embodiment the sub-volume 21 is connected by an overflow line 17 to the feed line to the sub-volume 22: as soon as the piston 18 moves beyond a predeterminable position the overflow line 18 previously closed by the piston 18 is opened. The piston 18 therefore acts as a slider in relation to the overflow line 17. As a result the previously separated sub-volumes 21, 22 are connected together. Fuel is then taken from the total volume formed by the sub-volumes 21, 22. That actuating position is selected for the diesel mode in which larger injection amounts are called up.

An alternative embodiment with variable sub-volumes 21, 22 is shown in FIG. 6. Here the piston 18 closes the sub-volume 21 with respect to the sub-volume 22 as long as the control valve 23 remains closed. In this condition fuel is taken from the (smaller) sub-volume 22, as is required for example in the dual fuel mode.

Opening of the control valve 23 leads to the spring chamber 24 in which the spring pack 19 is disposed being relieved of load. As a result the piston 18 now moves due to the pressure in the sub-volume 22 in opposition to the spring pack 19 (upwardly in the Figure). As the operative surface areas of the piston 18 in relation to the hydraulic pressure in the sub-volume 22 are almost equalized load relief of the spring chamber 24 causes the described movement.

The head portion (not shown in the Figure) of the piston 18 thereby opens the sub-volume 22 in relation to the sub-volume 21. As a result the previously separated sub-volumes 21 and 22 are connected together. Fuel is then taken from the total volume formed by the sub-volumes 21, 22, as is advantageous for example in the diesel mode. The communication between the sub-volumes 21, 22 is made through the overflow line 17.

FIG. 7 shows an embodiment with a variable storage volume 20. Here the storage volume 20 is not divided up into two discrete sub-volumes 21, 22 but the entire storage volume 20 is adapted to be variable in its volume connected to the nozzle assembly 10.

For that purpose there is provided a displaceable piston 18, by the movement of which the storage volume 20 communicating with the nozzle assembly 10 is varied. The piston 18 is braced by the spring pack 19 towards the volume 20. The spring pack here is provided by way of example in the form of a conical spring. The Figure shows the piston 18 in its end position involving the smallest storage volume 20. That would correspond to the position in the dual fuel mode. Advantageously in that position the storage volume 20 is of a volume corresponding to that of the (smaller) sub-volume 22. The spring pack 19 is relieved of stress in that case.

When the spring chamber 24 is switched by way of the control valve 23 to a reduced-pressure state the piston 18 moves in opposition to the spring pack 19 (upwardly in the Figure), for the pressure of the high pressure rail 8 is applied to the storage volume 20.

As a result the storage volume 20 available for taking fuel is increased and at the same time the overflow line 17 is opened. The arrangement is so designed that, when the piston 18 has moved back to the second abutment point (that is to say with the spring pack 19 stressed) the resulting storage volume 20 is dimensioned for the diesel mode.

FIG. 8 shows a further embodiment with a variable storage volume 20. In order to provide for switching over between the operating modes dual fuel mode and diesel mode the spring force of the valve 25 which is in the form of a passive valve is of such a magnitude that, at the pressures which are usually higher in the diesel mode (than in the dual fuel mode) in the high pressure rail 8, the piston 18 is urged in the direction of a larger storage volume 20 and at the same time the overflow line 17 is opened. In the Figure this corresponds to an upward movement. The foregoing description relating to FIG. 7 applies in regard to the advantages and the dimensioning.

FIG. 9 shows the pressure variation in the storage volume, shown in relation to the crank angle in degrees for the case when withdrawing the small amount of fuel in the injection process in the dual fuel mode.

In the case of a fuel injector 1 in accordance with the state of the art (as shown in FIG. 1—here the storage volume 20, as in fact only an invariable volume exists in the state of the art), there is a scarcely measurable collapse in the pressure configuration. The solid (uppermost) line shows that pressure configuration at the storage volume 20, which is also shown in another scaling in FIG. 2.

The broken line shows the pressure configuration for a fuel injector 1 according to the invention at the sub-volume 22. There is a clear pressure configuration which can be well measured.

The rail pressure (pressure in the high pressure rail 8) is typically in a range of between 1000 bars and 2500 bars depending on the respective operating state. The pressure collapse in accordance with the state of the art, that is observed in the injection process, is of the order of magnitude of a few bars in the dual fuel mode and about 100 bars in the diesel mode.

The pressure collapse observed in the injection process in accordance with the invention is of the order of magnitude of for example between 50 and 100 bars in the dual fuel mode and about 100 bars in the diesel mode.

The resolution of a measurement can be improved to such an extent.

LIST OF REFERENCES USED

1 injector
2 feed and discharge throttle
3 aperture
4 aperture
6 control valve
7 aperture
8 high pressure rail
9 pressure sensor
10 nozzle assembly
11 control device
12, 12' switching element
13 displacement body
14 through-flow limiter
15 aperture
16 aperture
17 overflow line
18 piston
19 spring pack
20 storage volume
21, 22 sub-volumes
23 control valve
24 spring chamber
25 passive valve
26 aperture at piston

The invention claimed is:

1. A fuel injector comprising:

a storage volume comprising a first sub-volume and a second sub-volume;

a switching element connecting the first sub-volume and the second sub-volume to obtain an overall volume; and a nozzle assembly connected to the second sub-volume of a fixed volume and connected to the first sub-volume via the second sub-volume wherein the storage volume is variable by operation of a control signal.

2. The fuel injector according to claim 1, wherein the first sub-volume and the second sub-volume are arranged in a serial flow relationship.

3. The fuel injector according to claim 1, wherein the switching element is arranged between the first sub-volume and the second sub-volume, and is operable for varying fluid communication between the first sub-volume and the second sub-volume.

4. The fuel injector according to claim 3, wherein the switching element is an electrically or hydraulically actuable switching valve.

5. The fuel injector according to claim 1, wherein the first sub-volume is a cavity of variable capacity.

6. The fuel injector according to claim 5, wherein the variable capacity of the storage volume is variable by movement of a piston.

7. The fuel injector according to claim 6, wherein the piston is moveable within the storage volume.

8. An internal combustion engine having the fuel injector according to claim 1.

9. The internal combustion engine according to claim 8, further comprising a control unit operable to transmit signals to vary capacity of the storage volume of the fuel injector.

10. A method of operating the internal combustion engine having the fuel injector according to claim 1, wherein capacity of the storage volume of the fuel injector is varied based on an operating state of the internal combustion engine.

* * * * *